US010871283B2

(12) United States Patent
Schluter

(10) Patent No.: US 10,871,283 B2
(45) Date of Patent: Dec. 22, 2020

(54) WATERTIGHT LED ARRANGEMENT

(71) Applicant: Schluter Systems L.P., Plattsburgh, NY (US)

(72) Inventor: Werner Schluter, Iserlohn (DE)

(73) Assignee: Schluter Systems L.P., Plattsburg, NY (US)

( * ) Notice: Subject to any disclaimer, the term of this patent is extended or adjusted under 35 U.S.C. 154(b) by 0 days.

(21) Appl. No.: 16/514,737

(22) Filed: Jul. 17, 2019

(65) Prior Publication Data

US 2020/0025364 A1 Jan. 23, 2020

(51) Int. Cl.

| | |
|---|---|
| ***F21V 31/00*** | (2006.01) |
| ***F21K 9/90*** | (2016.01) |
| ***F21V 23/00*** | (2015.01) |
| ***F21S 4/28*** | (2016.01) |
| *F21Y 115/10* | (2016.01) |

(52) U.S. Cl.

CPC ..... *F21V 31/005* (2013.01); *F21K 9/90* (2013.01); *F21S 4/28* (2016.01); *F21V 23/001* (2013.01); *F21V 23/005* (2013.01); *F21Y 2115/10* (2016.08)

(58) Field of Classification Search

CPC .... F21K 9/90; F21S 4/28; F21V 15/01; F21V 23/001; F21V 23/005

See application file for complete search history.

(56) References Cited

U.S. PATENT DOCUMENTS

| | | | | |
|---|---|---|---|---|
| 9,085,903 | B2 | 7/2015 | Schlueter | |
| 9,243,798 | B2 | 1/2016 | Schlueter | |
| 9,267,670 | B2 | 2/2016 | Schlueter | |
| 9,435,920 | B2 | 9/2016 | Schlueter | |
| 10,280,633 | B2 | 5/2019 | Schlueter | |
| 2012/0002417 | A1 | 1/2012 | Li | |
| 2012/0140391 | A1* | 6/2012 | Nickel | E05B 19/043 361/679.01 |
| 2014/0168975 | A1* | 6/2014 | Ng | F21V 5/007 362/244 |
| 2018/0080616 | A1* | 3/2018 | Elwell | B60Q 1/0088 |

FOREIGN PATENT DOCUMENTS

| | | | |
|---|---|---|---|
| CN | 205655150 | U | 10/2016 |
| CN | 106287448 | A | 1/2017 |
| CN | 107869663 | A | 4/2018 |

* cited by examiner

*Primary Examiner* — Evan P Dzierzynski

(74) *Attorney, Agent, or Firm* — Thorpe North and Western, LLP

(57) ABSTRACT

A watertight LED arrangement is provided that extends in a longitudinal direction (L). The arrangement includes a strip-shaped LED board (3) provided with a multiplicity of LEDs (2) on its upper side and at least one cable (4) electrically connected to the LED board (3). A one-piece, elastically formed watertight sheath (6) which surrounds the LED board (3) and defines a light emission wall (5) at least on its upper side opposite the LEDs (2) receives the LED board (3) in a form-fitting manner. The sheath bears directly against the underside of the LED board (3), and a cavity (7) extending in the longitudinal direction (L) is provided between the upper side of the LED board (3) and the light emission wall (5).

19 Claims, 5 Drawing Sheets

L
D-D
XIII
II
II

WATERTIGHT LED ARRANGEMENT

PRIORITY CLAIM

Priority is claimed of and to German Patent Application Serial No. 10 2018 117 343.1, filed Jul. 18, 2018, which is hereby incorporated herein by reference in its entirety.

BACKGROUND OF THE TECHNOLOGY

Field of the Technology

The present technology relates generally to lighting solutions for use in wet environments.

Related Art

The present invention relates to a watertight LED arrangement extending in a longitudinal direction, having a strip-shaped LED board provided with a multiplicity of LEDs on its upper side, at least one cable electrically connected to the LED board and a one-piece, elastically formed watertight sheath which surrounds the LED board and defines a light emission wall at least on its upper side opposite the LEDs, the sheath receiving the LED board in a form-fitting manner.

Such LED arrangements are known in the prior art in a wide variety of designs. The elastic cover is usually made of a soft plastic, such as silicone or the like.

Two methods are currently being used to manufacture such LED arrangements.

In the first manufacturing method, the LED board is pre-produced in a first step in the form of an endless strip. In a second step, it is encapsulated in an extruder with one or more plastics so that the LED board is fully embedded in direct contact with the plastic. The arrangement thus achieved is then shortened according to the desired length of the LED arrangement to be manufactured. End caps are then pushed onto the free ends, one of the end caps being provided with a cable that is connected to the LED board. In a final step, the end caps are connected to the sheath in a watertight manner. An advantage of this first manufacturing method is that due to the use of the extruder, a very good quality can be achieved. This applies in particular to the surface quality of the surface of the sheath defining the light emission wall. One disadvantage, however, is that only several thousand meters can be produced economically in one piece. Another disadvantage is the obligatory use of end caps. On the one hand, these have to be connected to the sheath in a watertight manner, which is always a challenge. On the other hand, the end caps pushed onto the cover protrude outwards from the cover, so that the LED arrangement cannot be easily inserted into a profile as it would be desirable for a simple and visually appealing assembly of the LED arrangement. In addition, end caps, even if made of a translucent material, change the light color in the region of the end cap, which interferes with the external appearance. A further disadvantage is that the cable must always be provided in the area of an end cap. A cable protruding at another position to the underside of the LED arrangement could only be produced with a very high additional effort.

According to a second manufacturing method, the LED boards are manufactured directly to size in a first step and electrically connected to a cable at the desired position. The arrangement produced in this way is then inserted into a casting mould and encapsulated on all sides with the plastic so that the LED board is fully embedded in direct contact with the plastic. One advantage of this second method is that a wide variety of lengths can be produced directly to size in small batches without the use of end caps. One disadvantage, however, is that the manufacturing method is not yet sufficiently mature and/or controllable to be able to produce a light emission wall with a consistently high surface quality at low costs. In particular, the climatic environments under which the plastic hardens after casting have a strong effect on the quality of the surface finish that can be achieved.

SUMMARY OF THE TECHNOLOGY

As a result, it would be desirable to create an LED arrangement and a method for manufacturing such an arrangement that would at least partially eliminate the aforementioned disadvantages. In addition, it is always desirable to improve the light quality of LED arrangements.

Based on this prior art, one of the tasks of the present invention is to create an alternative LED arrangement of the type mentioned-above as well as an alternative method for manufacturing such an LED arrangement.

To solve this problem, the present invention creates an LED arrangement of the type mentioned-above, which is characterized in that the sheath bears directly against the underside of the LED board, and in that a cavity extending in the longitudinal direction is provided between the upper side of the LED board and the light emission wall. The direct application of the sheath to the underside of the LED board is realized during the manufacture of the LED arrangement by pouring liquid material directly onto the underside of the LED board during the manufacture of the sheath. The cavity between the LEDs of the LED board and the sheath is advantageous in that the light emitted by the LEDs can propagate before it penetrates the light emission wall and is emitted to the outside, significantly improving the light quality of the LED arrangement, in particular with respect to the uniformity of the emitted light in the longitudinal direction of the LED arrangement. A constant color temperature or light color is achieved. In contrast, LED boards embedded directly in the material of the sheath cause a shift of the color location depending on the layer thickness of the material above the LEDs, which is not desirable.

According to an embodiment of the present invention the LED board is provided at at least one of its free ends with a leaf region angled in the direction of the light emission wall. Alternatively, a sealing element extending upwards in the direction of the light emission wall, in particular blade-like or film-like formed, can be provided adjacent to the LED board. This leaf region or sealing element, the shape of which is preferably adapted to the shape of the cross-section of the cavity, prevents liquid material, from which a lower region of the sheath is poured, from penetrating into and filling the cavity during the manufacture of the LED arrangement.

Preferably, the cable projects outwardly from the underside of the LED board and is passed through the underside of the sheath. Thanks to this cable arrangement, a watertight seal is automatically created between the sheath, the cable and the LED board when the lower part of the sheath is poured during the manufacture of the LED arrangement. In addition, the positioning of the cable outlet on the underside of the sheath allows the light emission wall to be illuminated up to the two ends of the LED arrangement, as there is no cable outlet there.

The longitudinal edges of the LED board are preferably enclosed by the sheath in a form-fitting manner. In this way, a stable hold of the LED board within the sheath is ensured.

According to an embodiment of the LED arrangement of the invention, the sheath has a substantially cuboid outer shape, wherein in the upper region of the sheath projecting protrusions are formed, which, preferably, project laterally transversely to the longitudinal direction and extend in the longitudinal direction, the protrusions in particular terminating flush with the light emission wall. Thanks to such a design of the sheath, the LED arrangement can easily be inserted into a profile with a U-shaped cross-section, which is used in particular for mounting the LED arrangement.

The sheath is preferably made of a soft plastic, in particular silicon and/or PVC and/or PU.

Advantageously, a first sheath region forming the upper side and at least parts of the longitudinal sides of the sheath and a second sheath region forming at least parts of the underside of the sheath are manufactured in successive working steps, the sheath regions being connected to one another in a form-fitting manner in order to achieve the one-piece-formation of the sheath. The manufacturing of the two sheath regions in different steps makes it easy to create the cavity between the LED board and the first sheath region. In addition, different materials can be selected for the sheath regions.

Preferably, the first sheath region is manufactured from a first material which is partially transparent in such a way that the upper side of the LED board is not visible from the outside through the first material when the LEDs are switched off. This results in a very uniform appearance.

According to an embodiment of the present invention, the first material is colored, in particular in a grey tone, or the first sheath region is provided on its upper side with a translucent, colored coating. If, for example, the color shade of the coloring is chosen according to the color shade of the tiles surrounding the LED arrangement in the installed state, a very inconspicuous appearance of the LED arrangement is achieved when the LEDs are switched off.

Preferably, the first sheath region has a substantially U-shaped cross-section and recesses extending in a longitudinal direction for receiving the longitudinal edges of the LED board in a form-fitting manner. This allows the LED board to be received at the first sheath region during the manufacture of the LED arrangement, forming the cavity between the recesses, and then the second sheath region to be cast.

The second sheath region is advantageously manufactured from a second material which is transparent in such a way that the underside of the LED board is visible from the outside through the second material. For example, a user can see existing markings on the underside of the LED boards from the outside, such as markings showing where the LED board can be cut to shorten the LED arrangement.

According to an embodiment of the present invention, an end cap connected in a watertight manner to the sheath is provided on one end face. Such an end cap, which is preferably flush with the shape of the sheath, is available when the LED arrangement has been shortened.

The watertight connection is preferably an adhesive joint or a welded joint.

Preferably, the end cap has a projection projecting into the cavity, the cross section of the projection being adapted to the cross section of the cavity. This creates a connection between the end cap and the sheath in a form-fitting manner. The end cap or at least its projection is preferably transparent and/or translucent in order to enable illumination of the light emission wall up to the ends of the LED arrangement, even if an end cap is present.

The side walls of the end cap, looking at the longitudinal side of the LED arrangement from the outside, preferably each have a chamfer, which tapers from the underside of the sheath in the direction of the light emission wall, whereby in particular triangular side walls result. The advantage of an end cap shaped in this way is that several LED arrangements can be arranged directly next to each other in the longitudinal direction without there being any visible interruption between the respective light emission walls.

Furthermore, in order to solve the task mentioned above, this invention creates a method for manufacturing of a watertight LED arrangement extending in a longitudinal direction, in particular according to the present invention, comprising the steps of:

a) Providing an elongated LED board extending in a longitudinal direction and provided on its upper side with a plurality of LEDs and having a predetermined length;
b) Connecting a cable to the LED board;
c) Providing a substantially U-shaped first sheath region which is manufactured by extrusion from a watertight material and which forms an upper side defining a light emission wall and at least parts of longitudinal sides of a sheath of the LED arrangement and has recesses arranged opposite one another at a distance from the upper side and extending in the longitudinal direction for receiving the longitudinal edges of the LED board in a form-fitting manner;
d) Positioning the LED board provided with the cable in the recesses of the first sheath region such that the upper side of the LED board faces the light emission wall and the free ends of the LED board are arranged at approximately the same distance from the free ends of the first sheath region;
e) Closing the end faces of the arrangement created in step d), in particular by inserting the assembly into a suitably formed casting mould; and
f) Casting of a second sheath region forming at least a part of an underside of the sheath and sealing the end faces of the sheath using a watertight material.

Preferably, after positioning the LED board in step d), a cavity being between the upper side of the LED board and the light emission wall and extending in the longitudinal direction is closed at the ends, in particular a leaf region, which is provided at at least one free end of the LED board and whose shape is adapted to the cross sectional shape of the cavity, is angled in the direction of the light emission wall.

BRIEF DESCRIPTION OF THE DRAWINGS

Further features and advantages of the present invention become clear by the following description of an LED arrangement according to an embodiment of the present invention or a method for manufacturing of the LED arrangement with reference to the enclosed drawing. There is FIG. 1 an end face view of an LED arrangement according to a first embodiment of the present invention.

Same reference numbers subsequently refer to identical components of the same design.

DETAILED DESCRIPTION

Figures 1, 2, 12, 13, 14:
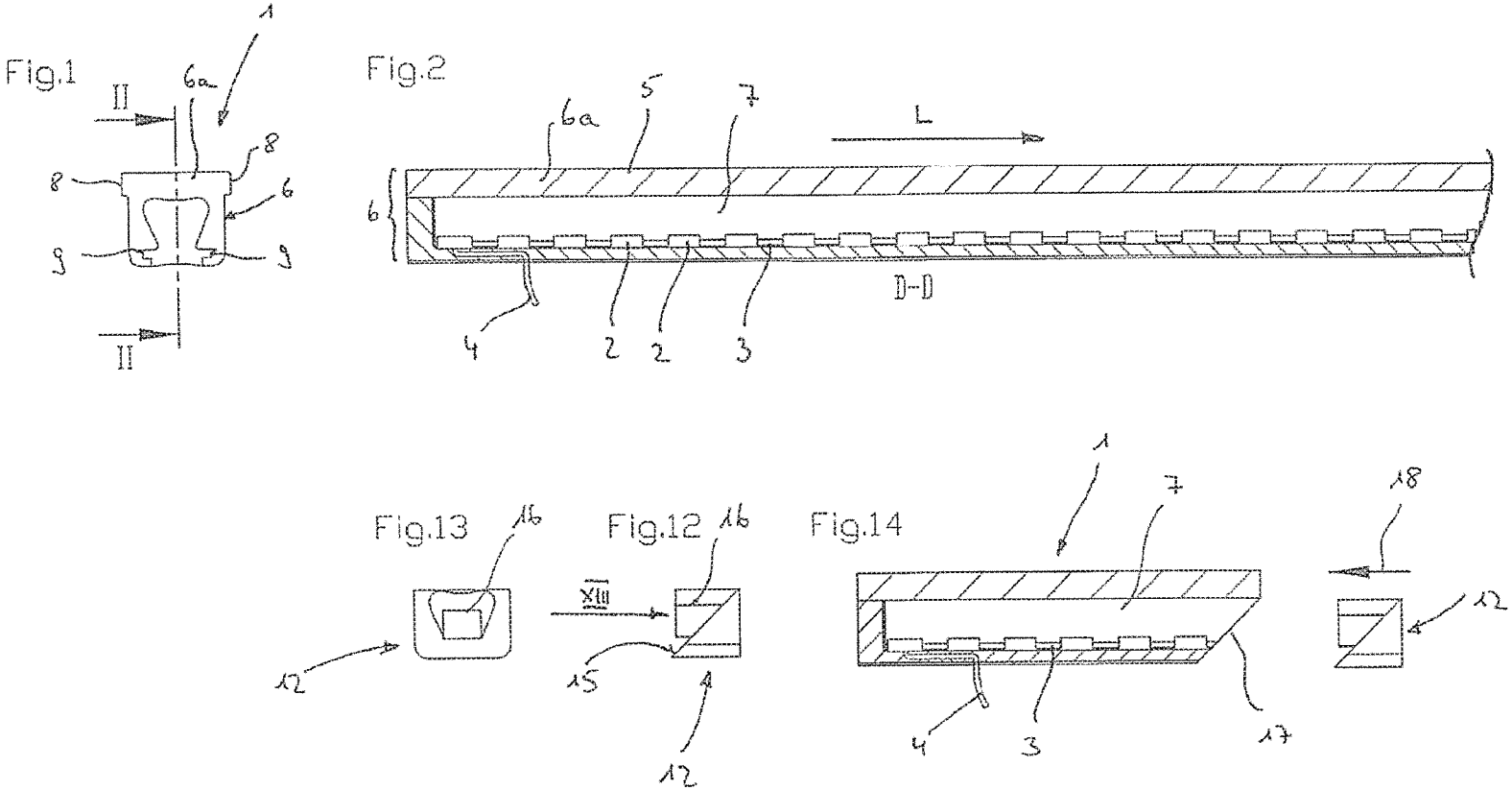
FIG. 2 a partial view of the LED arrangement cut along line II-II in FIG. 1.
FIG. 12 a side view of an end cap according to a first embodiment of the present invention.
FIG. 13 an end face view of the end cap in the direction of arrow XIII in FIG. 12.
FIG. 14 a view of the LED-arrangement shown in FIG. 2 in a shortened state, on which the end cap shown in FIGS. 12 and 13 is placed.

Reference will now be made to the exemplary embodiments illustrated in the drawings, and specific language will be used herein to describe the same. It will nevertheless be understood that no limitation of the scope of the technology is thereby intended. Alterations and further modifications of the inventive features illustrated herein, and additional applications of the principles of the technology as illustrated herein, which would occur to one skilled in the relevant art and having possession of this disclosure, are to be considered within the scope of the technology.

Definitions

As used herein, the singular forms "a" and "the" can include plural referents unless the context clearly dictates otherwise. Thus, for example, reference to "an LED" can include one or more of such brackets, if the context so dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present technology. Such terms include, without limitation, "upward," "downward," "horizontal," "vertical," etc. These terms are generally not intended to be limiting, but are used to most clearly describe and claim the various features of the technology. Where such terms must carry some limitation, they are intended to be limited to usage commonly known and understood by those of ordinary skill in the art in the context of this disclosure. In some instances, dimensional information is included in the figures. This information is intended to be exemplary only, and not limiting. In some cases, the drawings are not to scale and such dimensional information may not be accurately translated throughout the figures.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

FIGS. 1 and 2 show a watertight LED (light-emitting diode) arrangement 1 extending in a longitudinal direction L according to a first embodiment of the present invention. LED arrangement 1 comprises a strip-shaped LED board 3 provided on its upper side with a multiplicity of LEDs 2, a cable 4 electrically connected to the LED board 3 and a watertight sheath 6 which surrounds the LED board 3. The sheath 6 is formed in one piece and is elastic, defines a light emission wall 5 at least on its upper side and receives the LED board 3 in a form-fitting manner. Furthermore, a cavity 7 extending in the longitudinal direction L is provided between the upper side of the LED board 3 and the light emission wall 5.

Figure 11:
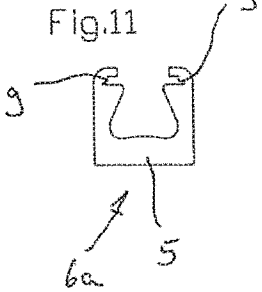
FIG. 11 an end face view analogue to FIG. 1 which shows a first sheath region according to a second embodiment of the present invention.

The sheath 6 has an essentially cuboid outer shape, whereby in the upper region of the sheath 6 protrusions 8, which project laterally transversely to the longitudinal direction L and extend in the longitudinal direction L, are formed, the protrusions 8 terminating flush with the light emission wall 5. The protrusions 8 are used to clamp the LED arrangement 1 in a U-shaped groove of a profile which is not shown in detail and which can be used to mount the LED arrangement 1. Alternatively, it is also possible to do without such protrusions 8 as shown in FIG. 11 as an example. The sheath 6 presently consists of a first sheath region 6*a* and a second sheath region 6*b*, which are connected to each other by a material bond and form a one-piece unit. The first sheath region 6*a* defines the upper side and thus the light emission wall 5, the longitudinal sides and a small part of the underside as well as a part of the end faces of the sheath 6, whereas the second sheath region 6*b* defines a large part of the underside and a part of the end faces of the sheath 6. The first sheath region 6*a* has a substantially U-shaped cross section and in its lower region recesses 9 extending in a longitudinal direction L for receiving the longitudinal edges of the LED board 3 in a form-fitting manner. The second sheath region 6*b* has the shape of a U, seen in a longitudinal cut view, and bears to the underside of the LED board 3. Both sheath regions 6*a* and 6*b* are manufactured from a soft plastic, in particular a silicone and/or PVC and/or PU. The material of the first sheath region is advantageously partially transparent, so that the upper side of the LED board 3 is not visible from the outside through the material, when the LEDs 2 are switched off. The material of the first sheath region 6*a* can be colored or provided with a translucent and colored coating on its upper side, for example in a grey tone, which can be desirable for the later application of the LED arrangement 1 in order to adapt the appearance of the LED arrangement to colors of materials surrounding the latter, such as the color of tiles, mortar or the like. The material of the second sheath region 6*b* is advantageously transparent so that the underside of the LED board 3 is visible from the outside through the material. In this way, markings provided on the other side of the LED board 3, which are not shown here, can be identified from the outside, such as markings that define positions at which the LED board 3 can be shortened. However, it should be clear that the sheath regions 6*a* and 6*b* can also be manufactured from a uniform material.

The LED board is provided at each of its two opposite free ends with a leaf region 10 bent in the direction of the light emission wall 5, the shape of which is adapted to the cross-sectional shape of the cavity 7. The function of these leaf regions 10 is described in more detail below.

The cable 4 is connected to the underside of the LED board 3, is preferably fixed to the underside of the LED board 3 using an adhesive, for example, over a predetermined distance in the longitudinal direction L, and then extends outwards through the second sheath region 6*b*. Accordingly, the cable 4 is strain-relieved and sealed by the second sheath region 6*b*.

In the following, with reference to FIGS. 3 to 10, the manufacture of LED board 1 using a method according to an embodiment of the present invention is described.

Figure 3:
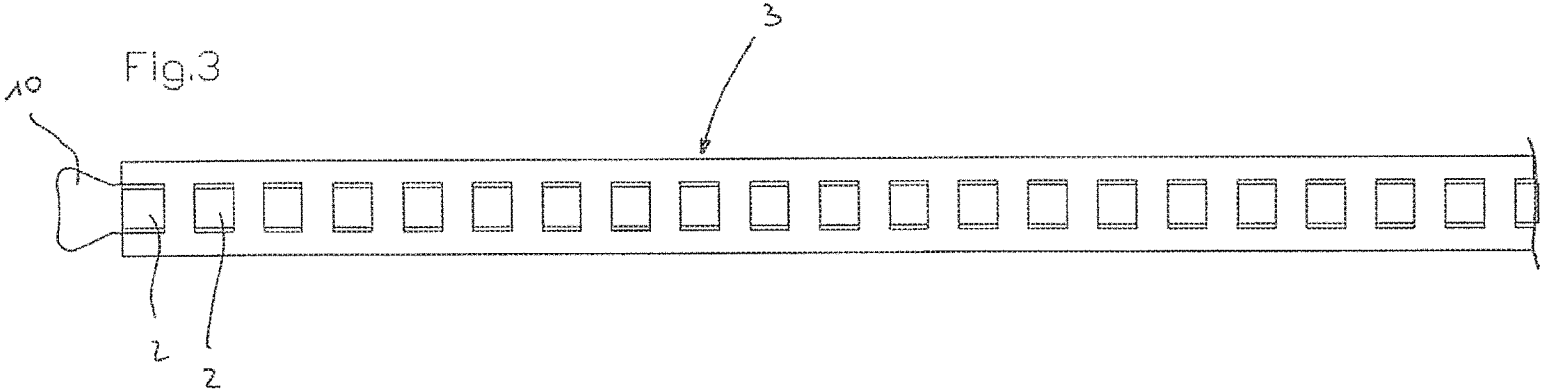
FIG. 3 a partial top view of an LED board of the LED arrangement shown in FIGS. 1 and 2.
Figure 4:
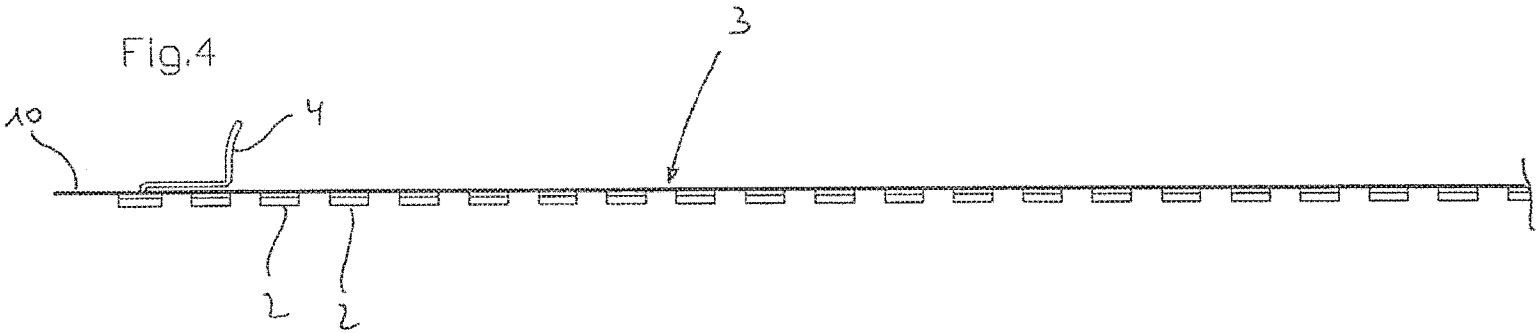
FIG. 4 a side view of the LED board shown in FIG. 3 with connected cable.

In a first step, LED board 3 is provided in a suitable predetermined length, see FIG. 3.

In a further step, the cable 4 is connected to the LED board, presently to the rear side of the LED board. The cable 4 is advantageously attached to the rear side of the LED board over a predetermined distance in a longitudinal direction L, for example by use of a suitable adhesive or the like.

Figure 5:
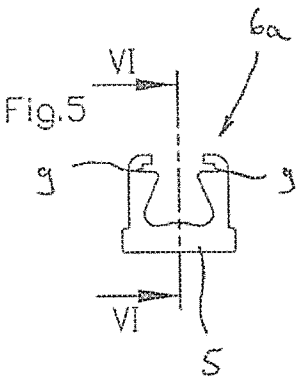
FIG. 5 an end face view of a first sheath region of a sheath of the LED arrangement shown in FIGS. 1 and 2.
Figure 6:
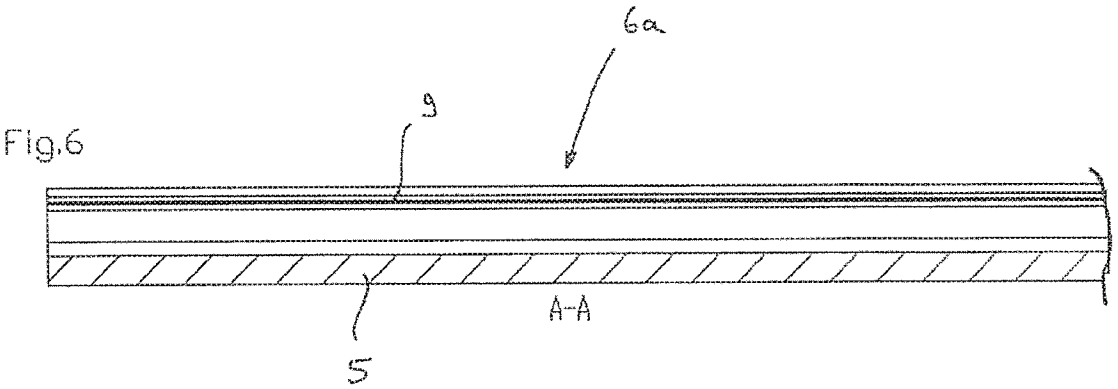
FIG. 6 a partial view of the first sheath region cut along line VI-IV in FIG. 5.

The first sheath region 6*a*, which was previously manufactured by extrusion, is then provided, see FIGS. 5 and 6.

Figure 7:
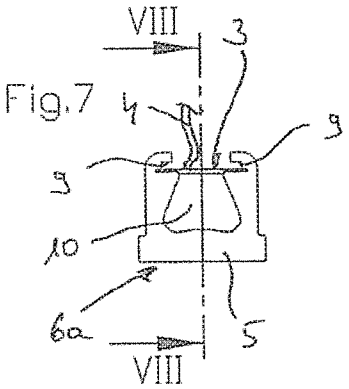
FIG. 7 an end face view of the first sheath region shown in the FIGS. 5 and 6, into which the LED board shown in the FIGS. 3 and 4 is inserted, wherein leaf regions provided at the free ends of the LED board are bent by 90 degrees in the direction of a light emission wall of the first sheath region.
Figure 8:
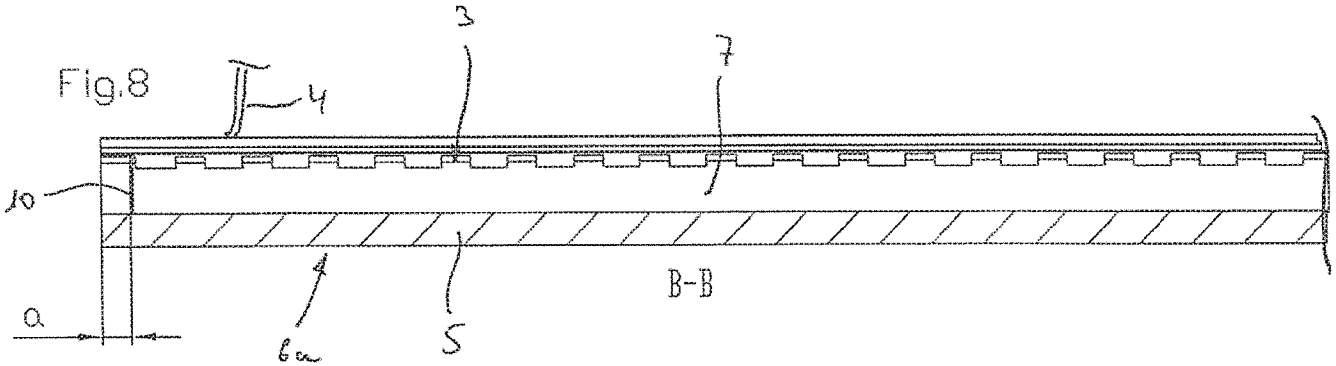
FIG. 8 a partial view cut along line VIII-VIII in FIG. 7.
Figure 9:
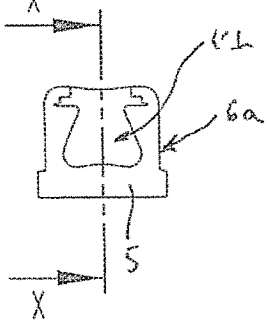
FIG. 9 an end face view of the arrangement shown in FIGS. 7 and 8 after casting a second sheath region.
Figure 10:
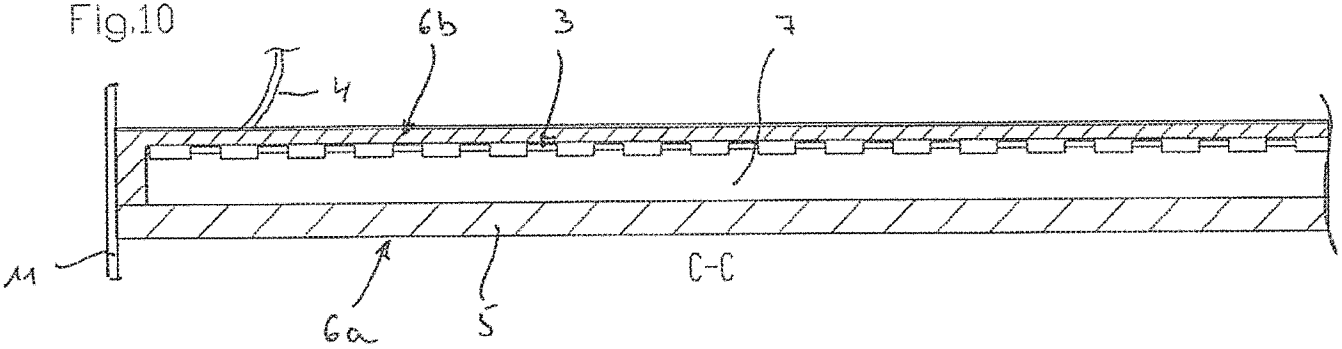
FIG. 10 a partial view cut along line X-X in FIG. 9.

Then, as shown in FIGS. 7 and 8, the LED board 3 provided with the cable 4 is positioned in the opposite recesses 9 of the first sheath region 6*a* such that the upper side of the LED board 3 and thus the LEDs 2 face to the light emission wall and the free ends of the LED board 3 are arranged at approximately the same distance from the free ends of the first sheath region 6*a*. Then the cavity 7 between the upper side of the LED board 3 and the light emission wall 5, extending in the longitudinal direction is closed at the end in the present case by bending the respective leaf regions 10 of the LED board 3, whose shape is adapted to the cross-sectional area of the cavity 7, by about 90 degrees in the direction of the light emission wall 5. In case that the LED board 3 is not provided with leaf regions 10, the end face closure of the cavity 7 can also be effected by correspondingly arranging sealing elements extending upwards in the direction of the light emission wall, in particular in the form of a blade or a film, the shape of which is preferably adapted to the cross sectional area of the cavity 7, for example in the form of adhesive strips or small plates. The length of the LED board 3 and the first sheath region 6*a* should be selected such that a distance a, which is advantageously at least 3 mm, is now set in the longitudinal direction between the leaf regions 10 and the corresponding free ends of the first sheath region 6*a*, so that the step described below can be carried out without problems.

Now the end faces of the arrangement thus obtained are closed, for example by using suitable plates 11, which can form part of a casting device. Now a liquid plastic is poured from above onto the underside of the LED board 3 and into the spaces between the leaf regions 10 of the board 3 and the plates 11 to form the second sheath region 6*b*. The material of the second sheath region 6*b* joins with that of the first sheath region 6*a*, resulting in a watertight, one-piece formed sheath 6.

In total, the method described above is characterized by the fact that LED arrangements 1 can be produced in any length in small quantities, in particular in small and medium series, simply and inexpensively. The manufacturing of the first sheath region 6*a* by extrusion is advantageous in that the light emission wall 5 can be produced with a high surface quality and flatness. The casting of the second sheath region 6*b* is not critical with regard to the surface quality to be achieved, since the underside of the LED arrangement 1 does not represent a visible surface. The cavity 7 ensures a constant color temperature or light color in the longitudinal direction L of the LED arrangement. A further advantage is that the materials of the two sheath regions 6*a* and 6*b* are freely selectable. The positioning of the cable 4 on the rear side of the LED board 3 makes it possible to arrange several LED arrangements 1 directly next to each other without optical interruption, which would not be possible if the cable was positioned on the end face of the LED arrangement.

In case that LED arrangement 1 is to be shortened for later installation, it must be cut at the appropriate position and then sealed in a watertight manner again. For sealing, an end cap 12 shown in FIGS. 12 and 13 is preferably used according to an embodiment of the present invention. The end cap 12 has an essentially rectangular shape when viewed from the front, analogue to the LED arrangement 1, and an essentially triangular shape when viewed from the side. In other words, the side walls 13 are each with a chamfer 14, which, in the inserted state as shown in FIG. 14, tapers towards the light emission wall 5 of the sheath 6 of LED arrangement 1. Starting from the inclined end face 15, an outward projecting projection 16, whose cross-section is adapted to the cross-section of the cavity 8 of the LED arrangement, extends in longitudinal direction L, so that it can be inserted into the cavity 8.

To shorten the LED arrangement, it is cut in a first step, whereby the course of the cut edge 17 is selected according to the inclination of the chamfers 14 of the end cap 12. In a further step, the end cap 12 is placed in the direction of the arrow 18 on the free end of the LED arrangement 1, whereby the projection 16 of the end cap 12 is inserted into the cavity 7 of the LED arrangement 1. The watertight connection between the end cap 12 and the LED arrangement 1 is realized by a watertight adhesive. The advantage of the end cap 12 is that it is not visible, or at least hardly visible, from the outside, starting from the light emission wall 5 of LED arrangement 1, thus achieving a very harmonious appearance.

It should be clear that the above described embodiments are only examples and should not be considered as restrictive. Rather, modifications are possible without leaving the scope of protection of the present invention, which is defined by the attached claims.

REFERENCE CHARACTER LIST

1 LED arrangement
2 LED
3 LED board
4 Cable
5 Light Emission Wall
6 Sheath
6*a* First Sheath Region
6*b* Second Sheath Region
7 Cavity
8 Protrusion
9 Recess
10 Leaf Region
11 Plate
12 End Cap
13 Side Wall
14 Chamfer
15 End Face
16 Projection
17 Cutting Edge
18 Arrow
L Longitudinal Direction
a Distance It is to be understood that the above-referenced arrangements are illustrative of the application of the principles of the present technology. Numerous modifications and alternative arrangements can be devised without departing from the spirit and scope of the present technology as set forth in the examples.

I claim:

1. A watertight LED arrangement (1) extending in a longitudinal direction (L), comprising:

a strip-shaped LED board (3) provided with a multiplicity of LEDs (2) on its upper side;

at least one cable (4) electrically connected to the LED board (3); and a one-piece, elastically formed watertight sheath (6) which surrounds the LED board (3) and defines a light emission wall (5) at least on its upper side opposite the LEDs (2), the sheath (6) receiving the LED board (3) in a form-fitting manner;

wherein the sheath bears directly against the underside of the LED board (3), and a cavity (7) extending in the longitudinal direction (L) is provided between the upper side of the LED board (3) and the light emission wall (5); and wherein the LED board (3) is provided on at least one of its free ends with a leaf region (10) angled in the direction of the light emission wall (5).

2. The LED arrangement (1) according to claim 1, wherein the cable (4) projects outwardly from the underside of the LED board (3) and is passed through the underside of the sheath (6).

3. The LED arrangement (1) according to claim 1, wherein longitudinal edges of the LED board (3) are enclosed by the sheath (6) in a form-fitting manner.

4. The LED arrangement (1) according to claim 1, wherein the sheath (6) has a substantially cuboid outer shape, wherein in the upper region of the sheath (6) projecting protrusions (8) are formed, which project laterally transversely to the longitudinal direction (L) and extend in the longitudinal direction (L), the protrusions (8) terminating flush with the light emission wall (5).

5. The LED arrangement (1) according to claim 1, wherein the sheath (6) is made of silicon and/or PVC and/or PU.

6. The LED arrangement (1) according to claim 1, wherein a first sheath region (6*a*) forming the upper side and at least parts of the longitudinal sides of the sheath (6) and a second sheath region (6*b*) forming at least parts of the underside of the sheath (6) are manufactured in successive working steps, the sheath regions (6*a*, 6*b*) being connected to one another in a form-fitting manner in order to achieve the one-piece-formation of the sheath (6).

7. The LED arrangement (1) according to claim 6, wherein the first sheath region (6*a*) is manufactured from a first material which is partially transparent such that the upper side of the LED board (3) is not visible from the outside through the first material when the LEDs (2) are switched off.

8. The LED arrangement (1) according to claim 7, wherein the first material is colored a grey tone, or wherein the first sheath region (6*a*) is provided on its upper side with a translucent, colored coating.

9. The LED arrangement (1) according to claim 7, wherein the first sheath region (6*a*) has a substantially U-shaped cross-section and includes recesses (9) extending in a longitudinal direction (L) for receiving the longitudinal edges of the LED board (3) in a form-fitting manner.

10. The LED arrangement (1) according to claim 7, wherein the second sheath region (6*b*) is manufactured from a second material which is transparent such that the underside of the LED board (3) is visible from the outside through the second material.

11. The LED arrangement (1) according to claim 1, further comprising an end cap (12) connected in a watertight connection to the sheath (6) on one end face.

12. The LED arrangement (1) according to claim 11, wherein the watertight connection is an adhesive joint or a welded joint.

13. The LED arrangement (1) according to claim 11, wherein the end cap (12) has a projection (16) projecting into the cavity (7), the cross section of the projection (16) being adapted to the cross section of the cavity (7).

14. The LED arrangement (1) according to claim 11, wherein the side walls (13) of the end cap (12), looking at the longitudinal side of the LED arrangement (1) from the outside, each have a chamfer (14), which tapers from the underside of the sheath (6) in the direction of the light emission wall (5), whereby triangular side walls (13) result.

15. A method of manufacturing a watertight LED arrangement (1) extending in a longitudinal direction (L), comprising:

obtaining an elongated LED board (3) extending in a longitudinal direction (L) and provided on its upper side with a plurality of LEDs (2) and having a predetermined length;

connecting a cable (4) to the LED board (3);

obtaining a substantially U-shaped first sheath region (6*a*) which is manufactured by extrusion from a watertight material and which forms an upper side defining a light emission wall (5) and at least parts of longitudinal sides of a sheath (6) of the LED arrangement (1) and has recesses (9) arranged opposite one another at a distance from the upper side and extending in the longitudinal direction (L) for receiving the longitudinal edges of the LED board (3) in a form-fitting manner;

positioning the LED board (3) provided with the cable (4) in the recesses (9) of the first sheath region (6*a*) such that the upper side of the LED board (3) faces the light emission wall (5) and the free ends of the LED board (3) are arranged at approximately the same distance (a) from the free ends of the first sheath region (6*a*);

closing end faces of the arrangement by inserting the assembly into a suitably formed casting mold; and casting a second sheath region (6*b*) forming at least a part of an underside of the sheath (6) and sealing the end faces of the sheath (6) using a watertight material.

16. The method according to claim 15, wherein, after positioning the LED board, a cavity (7) formed between the upper side of the LED board (3) and the light emission wall (5) and extending in the longitudinal direction (L) is closed at the ends, in particular in that a leaf region (10) which is provided on at least one free end of the LED board (3) and whose shape is adapted to the cross-sectional shape of the cavity (7) is angled in the direction of the light emission wall (5).

17. A watertight LED arrangement (1) extending in a longitudinal direction (L), comprising:

a strip-shaped LED board (3) provided with a multiplicity of LEDs (2) on its upper side;

at least one cable (4) electrically connected to the LED board (3); and a one-piece, elastically formed watertight sheath (6) which surrounds the LED board (3) and defines a light emission wall (5) at least on its upper side opposite the LEDs (2), the sheath (6) receiving the LED board (3) in a form-fitting manner;

wherein the sheath bears directly against the underside of the LED board (3), and a cavity (7) extending in the longitudinal direction (L) is provided between the upper side of the LED board (3) and the light emission wall (5); and wherein the LED board (3) is provided on at least one of its free ends with a sealing element extending upwards in the direction of the light emission wall (5), the sealing element being formed in a blade or a film.

18. The LED arrangement (1) according to claim 17, wherein the cable (4) projects outwardly from the underside of the LED board (3) and is passed through the underside of the sheath (6).

19. The LED arrangement (1) according to claim 17, wherein longitudinal edges of the LED board (3) are enclosed by the sheath (6) in a form-fitting manner.

* * * * *